United States Patent [19]

Placke et al.

[11] Patent Number: 4,640,505

[45] Date of Patent: Feb. 3, 1987

[54] DOCUMENT GUIDE MECHANISM

[75] Inventors: Dale L. Placke; Donald L. Weeks, both of Dayton, Ohio

[73] Assignee: NCR Corporation, Dayton, Ohio

[21] Appl. No.: 791,492

[22] Filed: Oct. 25, 1985

[51] Int. Cl.[4] ..... B65H 31/26

[52] U.S. Cl. ..... 271/209; 271/177; 271/188; 271/220

[58] Field of Search ..... 271/209, 188, 220, 224, 271/178, 177

[56] References Cited

U.S. PATENT DOCUMENTS

| | | | |
|---|---|---|---|
| 3,139,278 | 6/1964 | Maidment | 271/188 |
| 3,595,565 | 7/1971 | Bergland | 271/188 X |
| 3,844,553 | 10/1975 | Overfield et al. | 271/179 |
| 4,223,885 | 9/1980 | Templeton | 271/220 |
| 4,251,000 | 2/1981 | Templeton | 271/209 X |
| 4,285,511 | 8/1981 | Abe | 271/178 |

OTHER PUBLICATIONS

IBM Technical Disclosure Bulletin, vol. 17, No. 5, p. 138, Oct. 1974, "Paper Bin", J. A. Craft.

*Primary Examiner*—Richard A. Schacher

*Attorney, Agent, or Firm*—Wilbert Hawk, Jr.; Albert L. Sessler, Jr.; Elmer Wargo

[57] ABSTRACT

A document guide mechanism having an upstream end, a downstream end, and a feeding line therebetween. A cupping device including a cupping rib provides stiffness to the documents as they are moved along the feeding line from the upstream end towards the downstream end where the documents are stacked. A flexible band having predetermined parameters is used to form a "wave" which travels along the feeding line to move the trailing edges of documents already stacked away from the feeding line to provide an entrance for the leading edge of a document being moved along the feeding line towards the stacked documents.

7 Claims, 6 Drawing Figures

DOCUMENT GUIDE MECHANISM

BACKGROUND OF THE INVENTION

This invention relates to a document guide mechanism which is used to guide documents into a pocket as is done in document processing machines such as proof and sorting machines, for example.

Some of the problems with feeding financial documents, like checks, for example, are due to the extreme variation in size and condition of the documents and to the materials from which these documents are made. For example, the sizes of the documents processed in a financial proof machine can range from about 2½ to 4½ inches in height and from about 4½ to 9 inches in length in an intermixed batch of documents. Many of the documents like checks, for example, have been carried in wallets and have a "U"-bend in them. Others are "dog eared" or cut, or have wrinkles in them. Some checks are very thin and flexible while other checks are stiff and made from card stock. It is apparent that when 250 to 300 of such documents are grouped together to be processed in a batch as is done in processing financial documents, the variation in size, condition, and materials mentioned presents problems.

One of the operations which is performed in the processing of financial documents is to process a batch of such documents on a machine which performs a sorting function. This machine has a plurality of pockets into which the documents are routed and stacked based on certain data read from the documents. For example, all documents of a certain type or destination end up in a designated pocket while being retained in the processing sequence. As the documents accumulate in a pocket, the documents have a tendency to "fan out" and rest against a rib (feeding line) along which the incoming documents are guided. When this happens, the leading edge of an incoming document can hit the trailing edges of the pocketed documents causing problems. Often, this results in the incoming document being pocketed in between the previously pocketed documents, resulting in the incoming document being pocketed out of sequence with regard to the processing sequence mentioned. A worse result is to have the leading edge of an incoming document crash into the trailing edge of a pocketed document, resulting in a jam which requires the operator to stop the machine to clear the jam. Very often, the incoming document is crushed in accordion-like fashion by such a jam, making the crushed document unsuitable for further machine processing.

SUMMARY OF THE INVENTION

The present invention obviates the problems mentioned earlier herein. In a preferred embodiment, the document guide mechanism made according to this invention comprises: an upstream end, a downstream end, and a feeding line positioned therebetween; a receiving means located at said downstream end for receiving documents being pocketed; said documents which are pocketed in said receiving means having trailing edges which at times fan out towards said feeding line; feeding means located at said upstream end for feeding said documents sequentially along said feeding line; cupping means positioned between said feeding means and said receiving means for stiffening a document passing therethrough by forming concave and convex sides on said document; said cupping means including a cupping rib which is positioned along one side of said feeding line where said concave side is formed by said cupping means; and a flexible band having a portion which extends from said one side of said feeding line across said feeding line so as to be engaged by the leading edge of a document being fed by said feeding means; said flexible band having operating parameters to enable said flexible band to form a wave which progresses from said cupping means towards said receiving means as said leading edge of a document being fed progresses from said cupping means towards said receiving means to thereby move the trailing edges of said documents in said receiving means away from said feeding line to provide an entrance for the leading edge of said document being fed into said receiving means.

Some advantages of the present invention are that it is low in cost, and simple to install.

Another advantage is that the present invention does not interfere with the incoming documents when the use of the invention is not needed.

These advantages and others will become more readily understood in connection with the following specification, claims, and drawing.

DETAILED DESCRIPTION OF THE INVENTION

Figure 1:
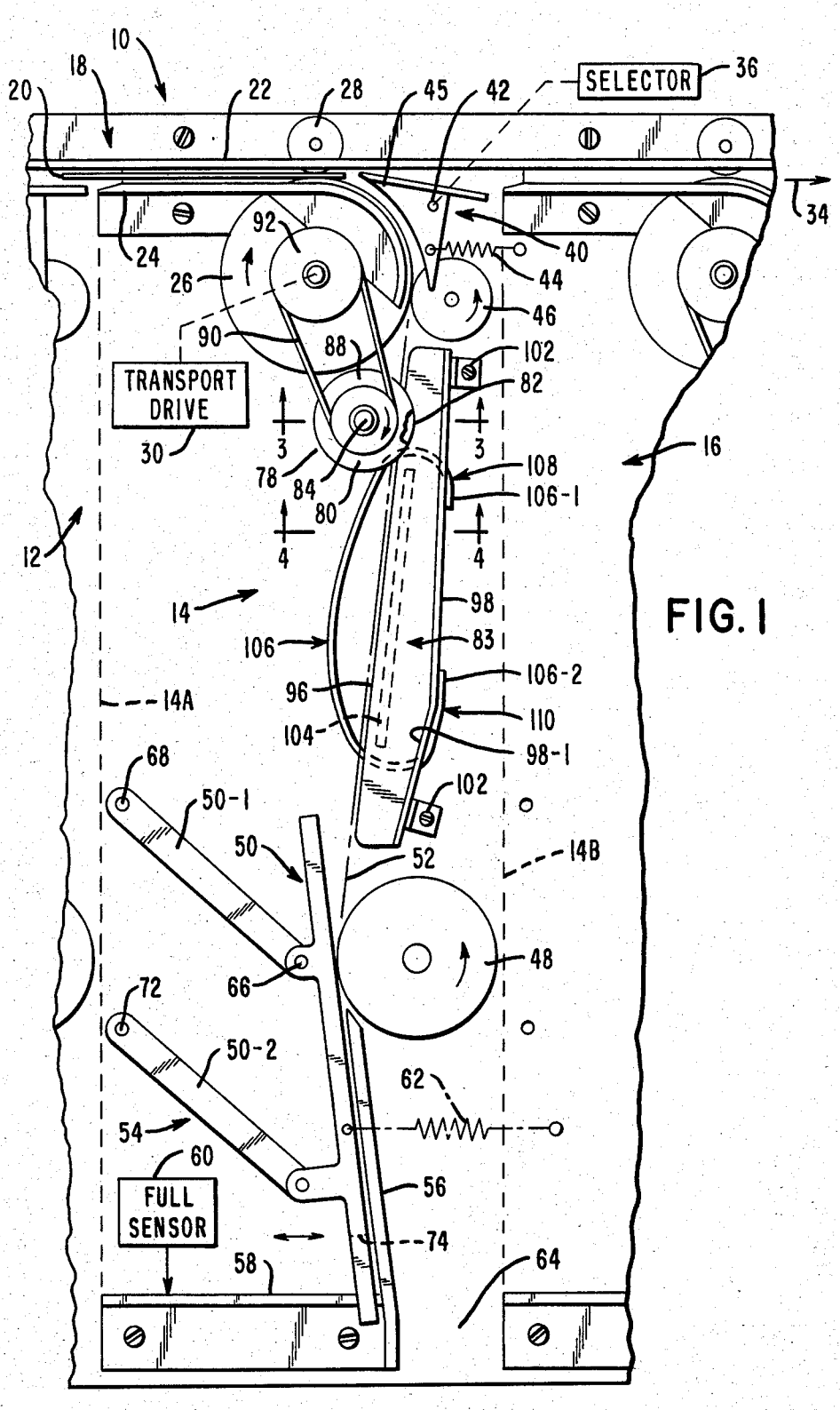
FIG. 1 is a plan view of a portion of a document processing machine, like a document sorting machine, in which a preferred form of this invention is incorporated.

FIG. 1 is a general, plan view of a portion of a document processing machine like a proof and encode machine or a sorter 10 which has a plurality of identical document guide mechanisms or sorting pockets 12, 14, and 16, for example, with only pocket 14 being shown in detail. Naturally, this invention may be used with a single pocket machine. The dashed lines **14*a* and 14*b* show the general side boundaries of the pocket 14**.

Figure 2:
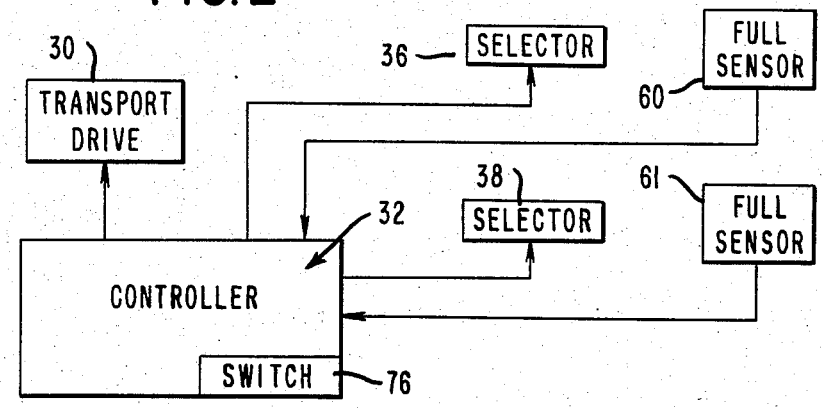
FIG. 2 is a schematic diagram of a means for controlling the operation of the document sorting machine as it applies to this invention.

The upper end of FIG. 1 includes a portion of the document track 18 in which the documents, like 20, are fed to the various pockets 12, 14 and 16 for sorting and stacking. The document track 18 is conventional, and it is comprised of upstanding walls 22 and 24 which are spaced apart to receive the document 20 therebetween. The wall 24 is suitably slotted to receive the periphery of a document driving roller 26, and similarly, wall 22 is slotted to receive the periphery of the associated pinch roller 28. The driving roller is rotated by a conventional transport drive 30 which is controlled by a controller 32 (FIG. 2) which also controls the operation of the sorter 10. As the documents, like 20, are moved along the document track 18 in the feeding direction shown by arrow 34, the controller 32 actuates the appropriate selector, like 36 and 38 (FIG. 2), to divert the approaching document 20 into the appropriate pocket, like 14 or 16, for example, in accordance with processing instructions retained by the controller 32. Each selector, like 36, is comprised of an actuator which is coupled to a diverter 40 which is mounted on a shaft 42. When the selector 36 is de-energized, a tension spring 44 is used to rotate the diverter 40 in a counter-clockwise direction from the position shown in FIG. 1 to a position in which the end 45 is moved out of the track 18 to permit documents to pass thereby. Correspondingly, when the selector 36 is energized by the controller 32, the diverter 40 is moved to the position shown in FIG. 1 to thereby divert the document 20 into the pocket 14. As previously stated, the pockets 12, 14 and 16 are identical; consequently, only a discussion of pocket 14 will follow.

Pocket 14 (FIG. 1) has an upstream end located between the periphery of driving roller 26 and the associated pinch roller 46, and it also has a downstream end which is located between the periphery of the drive roller 48 and the pusher plate 50. The documents 20 are fed between the upstream and downstream ends mentioned along a feeding line positioned therebetween and represented by dashed line 52.

A receiving means designated generally as 54 (FIG. 1) is positioned at the downstream end of the pocket 14, and its function is to receive and stack the documents which are being pocketed. The receiving means 54 includes the pusher plate 50 and drive roller 48 already alluded to, and it also includes the stationary wall 56, the stop wall 58, and a "full sensor" 60. Full sensor 61 (FIG. 2) is associated with pocket 16. The very first document 20 received in the pocket 14 is fed between the stationary wall 56 and the pusher plate 50. As additional documents 20 are moved to the receiving means 54, each subsequent document is placed in front of the prior document. Some may view the operation as having each subsequent document placed behind (to the right as viewed in Fig. 1) of the prior document. Accordingly, the most recent document 20 inserted properly into the receiving means 54 will be located next to the stationary wall 56. As the documents 20 are inserted into the receiving means 54, the leading edges of the documents abut against the stop wall 58, and as an increasing number of documents accumulates in the receiving means 54, the pusher plate 50 is moved to the left (as viewed in FIG. 1) to accommodate the resulting increasing stack. The pusher plate 50 is resiliently biased to move towards the stationary wall 56 by a tension spring 62 which is shown only schematically. The mounting plate 64 is positioned generally horizontally within the sorter 10. The pusher plate 50 is mounted for parallel movement relative to the stationary plate 56 via a "four-bar, parallel-motion mechanism" which includes the links 50-1 and 50-2. One end of link 50-1 is pivotally joined to the pusher plate 50 by a pin 66, and the remaining end of link 50-1 is pivotally joined to a pin 68 which is upstanding from the mounting plate 64. Correspondingly, one end of link 50-2 is pivotally joined to the pusher plate 50 by a pin 70, and the remaining end is pivotally joined to a pin 72 which is upstanding from the mounting plate 64. As documents 20 are stacked in the receiving means 54, the pusher plate 50 moves away from the stationary wall 56 to accommodate the increasing stack of documents. The lower end of pusher plate 50 is notched as at 74 to enable the lower end (as viewed in FIG. 1) of pusher plate 50 to move over the stop wall 58. When the pusher plate 50 approaches the full sensor 60 due to an increasing number of documents 20 being stacked in the receiving means 54, the full sensor 60 sends a signal to the controller 32 (FIG. 2) to stop the transport drive 30. After the documents in the receiving means 54 are removed by an operator, operation of the document sorting function is resumed by actuating a resume switch 76 associated with the controller 32.

The sorter 10 (FIG. 1) also includes a cupping means 78 which is located between the driving wheel 26 and the receiving means 54. The purpose of the cupping means 78 is to provide some rigidity or stiffness to the documents 20 as they are moved along the feeding line 52 towards the receiving means 54. In the embodiment described, the documents 20 are moved at a velocity of 100 inches per second towards the receiving means 54. The cupping means 78 includes the cupping rollers 80 and 82 (FIG. 3) and a cupping rib designated generally as 83. The rollers 80 and 82 have elastomeric peripheries to engage a document 20 to drive it towards the receiving means 54. Rollers 80 and 82 are fixed to the shaft 84 to rotate therewith, and shaft 84 is mounted perpendicularly to mounting plate 64 for rotation in a clockwise direction as viewed in FIG. 1. The means for mounting the shaft 84 is conventional and is shown conveniently as a bushing 86 which is fixed to the mounting plate 64. The upper end of shaft 84 (FIG. 3) has a pulley 88 fixed thereto to rotate the shaft 84 and the rollers 80 and 82 thereon. The pulley 88 is driven by an "O-ring" belt 90 which is coupled to a driving pulley 92 associated with the driving roller 26. In the embodiment described, the distance between the cupping rollers 80 and 82 is about $2\frac{1}{2}$ inches to handle the range of document sizes mentioned earlier herein; however, the distance can be changed to accommodate different sizes as part of an initial set up.

Figure 3:
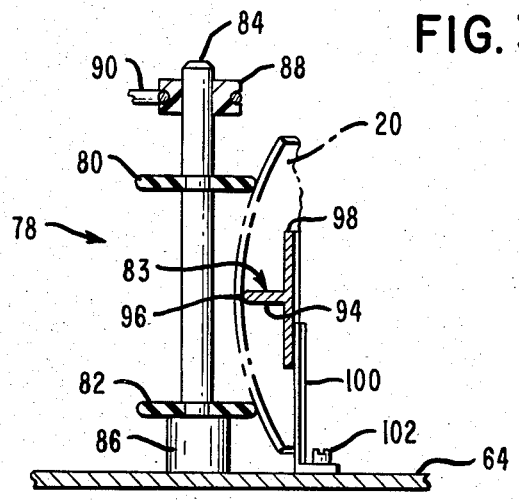
FIG. 3 is a cross-sectional view, taken along the line 3—3 of FIG. 1, to show additional details of a cupping means for providing stiffness to the documents to be pocketed or stacked.

The cupping rib 83 alluded to earlier herein has a generally-planar, horizontal section 94 which is positioned between the cupping rollers 80 and 82 as shown in FIG. 3. The cupping rib 83 has an edge 96 which extends along the feeding line 52 as shown in FIG. 1, and it also has a rib 98 to provide rigidity to the cupping rib 83. The cupping rib 83 is conventionally mounted on the mounting plate 64 by a mounting bracket 100 and fasteners 102. Notice that the cupping rib 83 is closer to the longitudinal axis of the shaft 84 than are the peripheries of the cupping rollers 80 and 82; this changes the form of a document 20 from a generally flat planar one to one which is formed into a portion of a cylindrical wall with the concave side facing the cupping rib 83 and the convex side facing the cupping rollers 80 and 82. Forming a document into a portion of a cylindrical wall increases the stiffness or rigidity of the document 20 and thereby facilitates the transfer of documents to the receiving means 54.

Figure 4:
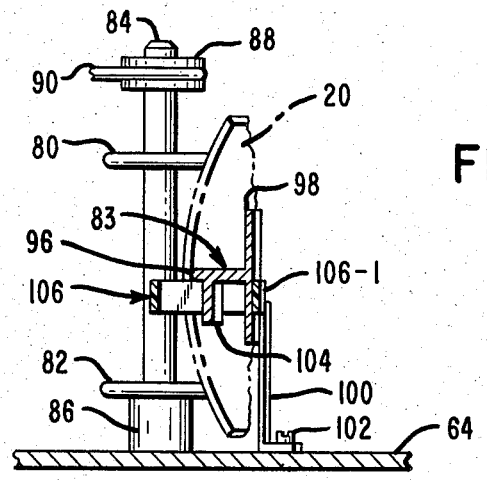
FIG. 4 is a cross-sectional view, taken along line 4—4 of FIG. 1, to show additional details of the cupping rib shown in FIG. 3 and a flexible band which cooperates with the cupping rib to facilitate the entry of documents into the receiving means.

The cupping rib 83 also includes a back-up rib 104 which depends from the underside of the cupping rib 83 as viewed best in FIG. 4. The back-up rib 104 is positioned parallel to the leading edge 96 of the cupping rib 83 and is positioned a small distance away from the leading edge 96 thereof. The function of the back-up rib 104 will be described hereinafter.

The pocket 14 also includes a flexible band designated generally as 106 (FIG. 1) whose function is to facilitate the transfer of documents 20 into the receiving means 54. When there are no documents in the pocket 14, for example, the band 106 assumes the shape shown in FIG. 1. The band 106 is exaggerated in thickness to facilitate a showing thereof; however, in the embodiment described, the band 106 is made of plastic film material like MYLAR (a trademark of E.I. Dupont de Nemours & Company), having a thickness of 0.004" inch, a width of 9/32 inch, and a free-loop length of approximately 6¼ inches as operating parameters for handling the range of sizes of documents mentioned earlier herein. The free-loop length of about 6¼ inches is approximately ⅔ of the maximum length of documents 20 processed in the embodiment described. Naturally, the dimensions of the band 106 can vary for different applications or for different ranges of sizes of documents. The band 106 has one end 106-1 which is secured to the rib 98 (FIG. 4), with the free-loop length of the band 106 beginning at the point designated by arrow 108 (Fig. 1) and extending to the point designated by arrow 110 where the remaining end 106-2 is secured to the rib 98. The rib 98 is angled near the area 98-1 of rib 98; this forms the band 106 into a somewhat bulbous or pear shape at the downstream end of the band 106.

Figure 5:
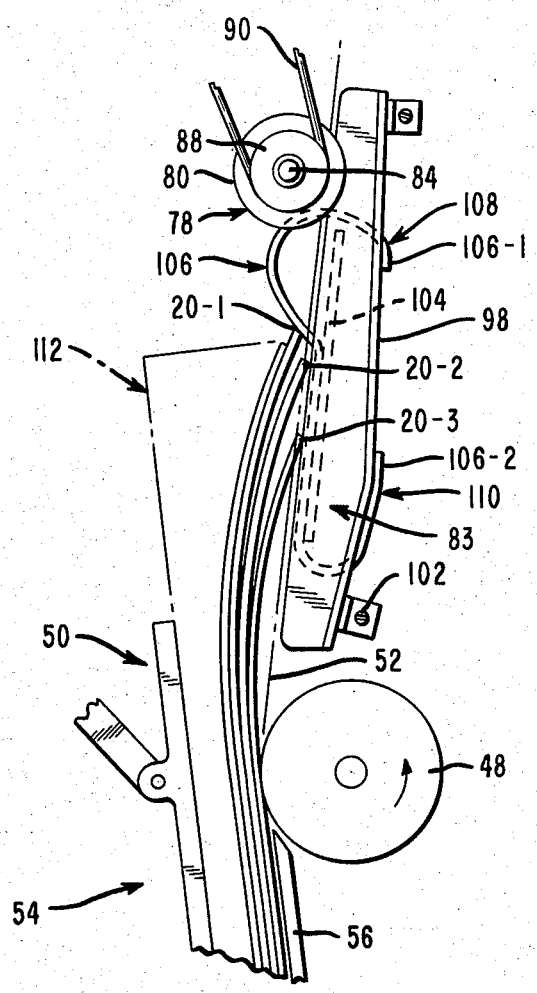
FIG. 5 is a plan view, similar to FIG. 1, showing how the ends of some documents "fan" over towards the feeding line to interfere with the leading edge of the next incoming document.

While FIG. 1 shows the position of the band 106 when no documents are stacked within the receiving means 54 or when no documents contact the band 106, FIG. 5 shows the position and shape of the band 106 when a stack 112 of documents is present and the documents provide interference. Notice that some of the ends 20-1, 20-2, and 20-3 of the documents fan out towards the feeding line 52 and would normally interfere with the leading edge of the next succeeding document to be pocketed. However, with the technique embodying the band 106 and the rib 104, this interfering is obviated as explained hereinafter.

Figure 6:
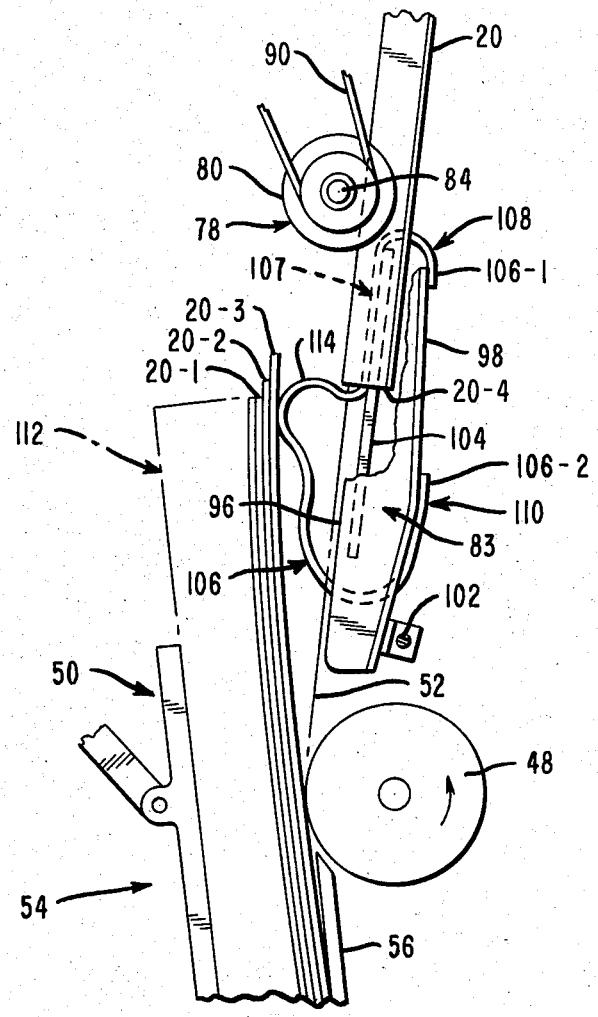
FIG. 6 is a plan view, similar to FIG. 5, showing how a wave is formed in a flexible band which facilitates the entry of documents into the receiving means.

FIG. 5 shows the shape of the band 106 just prior to the leading edge of a document 20 contacting it. Notice that the band 106 extends from the right side (FIG. 5) of the feeding line 52 where the leading edge 20-4 (FIG. 6) of a document 20, coming from the cupping rollers 80 and 82, contacts the band 106 to form the wave 114 as shown in FIG. 6. As the document 20 advances along the feeding line 52, the wave 114 advances downstream towards the receiving means 54, and in the process, it moves the trailing edges 20-1, 20-2, and 20-3, for example, of the documents out of the path of the leading edge 20-4 of the incoming document 20 as shown in FIG. 6. This enables the document 20 to be pocketed in the receiving means 54 in the proper order, i.e. in front of the last prior document deposited therein i.e. next to the stationary plate 56. During the time that the wave 114 travels along the feeding line 52, portions of the free-loop length of the band 106 abut against the back-up rib 104 as shown in the area of arrow 107. In the embodiment described, the back-up rib 104 is displaced from the leading edge 96 of the cupping rib 83 by a distance of 0.080 inch; this distance permits the free-loop length of the band 106 to slide upstream along the feeding line 52 after the wave 114 has been pushed to the downstream end by the leading edge 20-4 of the document 20. This enables the band 106 to assume the position shown in FIG. 5 in readiness for the next incoming document.

A feature of this invention is that wave 114 in the band 106 (FIG. 6) is formed only when needed. For example, if the ends 20-1, 20-2, and 20-3 do not form a potential interference as shown in FIG. 5 by pushing the band 106 against the back-up rib 104 (FIG. 4), there will be no wave 114 formed in the band 106. Consequently, the band 106 will be pushed aside by the incoming edge 20-4 of a document 20, and the document 20 will be inserted in the receiving means 54 in a routine manner.

What is claimed is:

1. A document guide mechanism comprising:

an upstream end, a downstream end, and a feeding line positioned therebetween;

a receiving means located at said downsteam end for receiving documents to be pocketed; said documents which are pocketed in said receiving means having trailing edges which at times fan out towards said feeding line;

feeding means located at said upstream end for feeding said documents sequentially along said feeding line;

cupping means positioned between said feeding means and said receiving means for stiffening a document passing therethrough by forming concave and convex sides on said document; said cupping means including a cupping rib which is positioned along one side of said feeding line where said concave side is formed by said cupping means; and a flexible band having a portion which extends from said one side of said feeding line across said feeding line so as to be engaged by the leading edge of a document being fed by said feeding means;

said flexible band having operating parameters to enable said flexible band to form a wave which progresses from said cupping means towards said receiving means as said leading edge of a document being fed progresses from said cupping means towards said receiving means to thereby move the trailing edges of said documents in said receiving means away from said feeding line to provide an entrance for the leading edge of said document being fed into said receiving means;

said cupping means including a pair of spaced driving rollers with said cupping rib being positioned between said pair of spaced driving rollers, said cupping rib also including a back-up rib which is positioned parallel to and spaced from said feeding line to provide a back up for said portion of said flexible band.

2. The mechanism as claimed in claim 1 in which said flexible band has first and second ends which are secured to said cupping means on said one side of said feeding line to enable said portion to extend across said feeding line; said portion between said first and second ends having a free loop length of approximately two thirds of the maximum length of said documents.

3. The mechanism as claimed in claim 2 in which the maximum length of said documents is nine inches and said free loop length of said band is approximately 6½ inches.

4. The mechanism as claimed in claim 3 in which said flexible band has a width of approximately 9/32 inch and a thickness of approximately 0.004 inch.

5. The mechanism as claimed in claim 4 in which said flexible band is made of a plastic film material, and said documents are fed along said feeding line at a velocity of approximately 100 inches per second.

6. The mechanism as claimed in claim 1 in which said flexible band has a width which is very small compared to the height of said documents.

7. The mechanism as claimed in claim 6 in which said width of said flexible band is approximately 9/32 inch and a maximum height of said documents is approximately $4\frac{1}{2}$ inches.

* * * * *